US010539905B2

(12) United States Patent
Wakamiya

(10) Patent No.: US 10,539,905 B2
(45) Date of Patent: Jan. 21, 2020

(54) IMAGE FORMING APPARATUS WITH CONTROLLED START-UP OF SCANNING MOTOR

(71) Applicant: CANON KABUSHIKI KAISHA, Tokyo (JP)

(72) Inventor: Hidehiro Wakamiya, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/110,845

(22) Filed: Aug. 23, 2018

(65) Prior Publication Data

US 2019/0064692 A1 Feb. 28, 2019

(30) Foreign Application Priority Data

Aug. 28, 2017 (JP) ..... 2017-163643

(51) Int. Cl.

| | |
|---|---|
| ***G03G 15/04*** | (2006.01) |
| ***G03G 15/08*** | (2006.01) |
| ***G03G 15/043*** | (2006.01) |
| ***G03G 15/01*** | (2006.01) |

(52) U.S. Cl.

CPC ..... *G03G 15/043* (2013.01); *G03G 15/011* (2013.01); *G03G 15/0121* (2013.01)

(58) Field of Classification Search

CPC ..... G03G 15/043; G03G 15/011; G03G 15/0121; B41J 2/442; B41J 2/473; G02B 26/122; G02B 26/127; G02B 26/129

See application file for complete search history.

(56) References Cited

U.S. PATENT DOCUMENTS

| | | | | |
|---|---|---|---|---|
| 6,064,419 | A | 5/2000 | Uchiyama | 347/250 |
| 9,827,783 | B2 | 11/2017 | Mizuta et al. | B41J 2/473 |
| 2010/0247121 | A1* | 9/2010 | Shimba | G03G 15/01 399/43 |
| 2013/0108290 | A1* | 5/2013 | Funatani | G03G 15/043 399/43 |
| 2016/0085173 | A1* | 3/2016 | Mizuta | G02B 26/122 399/216 |

FOREIGN PATENT DOCUMENTS

| | | |
|---|---|---|
| JP | H08-183198 | 7/1996 |
| JP | 3290810 | 6/2002 |
| JP | 2014-077881 | 5/2014 |
| JP | 2015-009485 | 1/2015 |

* cited by examiner

*Primary Examiner* — Sophia S Chen
(74) *Attorney, Agent, or Firm* — Venable LLP

(57) ABSTRACT

An image forming apparatus: includes a developing member to be movable between a development position where the developing member contacts an image bearing member and a separated position where the developing member is separated from the image bearing member; and a control portion controls the number of rotations of a drive portion by causing a light source to emit a light beam when a rotating polygon mirror starts to rotate, and detecting the light beam emitted from the light source by a detecting portion, wherein when the rotating polygon mirror starts to rotate, the light beam does not enter an image region of the image bearing member and the light beam is detected outside the image region of the image bearing member by the detecting portion, in a state of the developing member having moved from the separating position to the development position.

15 Claims, 10 Drawing Sheets

IMAGE FORMING APPARATUS WITH CONTROLLED START-UP OF SCANNING MOTOR

BACKGROUND OF THE INVENTION

Field of the Invention

The present invention relates to an image forming apparatus which includes a rotating polygon mirror that scans a light beam onto an image bearing member, and a developing member that contacts or separates from a photosensitive drum, and more particularly, to a control technique to detect the number of rotations of the rotating polygon mirror at startup using a light beam.

Description of the Related Art

This type of image forming apparatus is disclosed in Japanese Patent No. 3290810, for example. In this image forming apparatus, when a scanning motor (drive unit) is started up, the scanning motor is forcibly rotated to cause the laser to emit for a predetermined time, and the laser beam scanned by a polygon mirror (rotating polygon mirror) is detected by a detecting unit. Then the number of rotations of the scanning motor is detected based on the period of the detection signal, and it is determined whether the detected the number of rotations reaches the predetermined number of rotations. If the number of rotations does not reach the predetermined number of rotations, the number of rotations is repeatedly detected after a predetermined time elapses. In Japanese Patent No. 3290810, the laser is forcibly emitted periodically, regardless the non-image region or image region of the photosensitive drum (image bearing member). Japanese Patent Application Publication No. H08-183198, on the other hand, discloses that when the scanning motor is started, the scanning motor is controlled by emitting the laser outside the image region (unblanking control). In other words, a period of the detection signal in the previous scanning is detected by the detecting unit, and the period of the next detection signal is estimated based on this signal. By generating the unblanking signal, the detection signal of the laser light can be acquired without continuously emitting the laser, whereby the start up of the scanning motor is controlled.

SUMMARY OF THE INVENTION

An image forming apparatus includes a developing member configured to develop an electrostatic latent image formed on a photosensitive drum using developer. This developing member can move between a development position where the developing member contacts the photosensitive drum, and a separated position where the developing member is separated from the photosensitive drum, and the developing member moves from the separated position to the development position when an image is formed. This developing member is preferably in contact with the photosensitive drum when the scanning motor reaches a steady rotation. However if the developing member contacts the photosensitive drum in the state when the laser is forcibly emitted to the photosensitive drum, including the image region, to start up the scanning motor as in the case of Japanese Patent No. 3290810, the developer adheres to the portion where the laser beam is irradiated.

It is an object of the present invention to provide an image forming apparatus that allows the developing member to contact the image bearing member without concern for the adhesion of developer to the image bearing member, even when forcibly accelerating the scanning motor for start up, and decreases the output time of the first print.

In order to achieve the object described above, an image forming apparatus according to an embodiment of present invention includes:

a scanning portion including a light source configured to emit a light beam, a rotating polygon mirror configured to reflect the light beam emitted from the light source in order to periodically scan an image bearing member, and a drive portion configured to drive the rotating polygon mirror;

a detecting portion configured to detect the light beam emitted from the light source;

a developing member configured to be movable between a development position where the developing member contacts the image bearing member and a separated position where the developing member is separated from the image bearing member; and a control portion configured to control emission of the light source, operation of the drive portion of the rotating polygon mirror and movement of the developing member, wherein the control portion controls the number of rotations of the drive portion by causing the light source to emit the light beam when the rotating polygon mirror starts to rotate, and detecting the light beam emitted from the light source by the detecting portion, and when the rotating polygon mirror starts to rotate, the light beam does not enter an image region of the image bearing member and the light beam is detected outside the image region of the image bearing member by the detecting portion, in a state of the developing member having moved from the separating position to the development position.

According to the present invention, the developing member can contact the image bearing member without concern for the adhesion of developer to the image bearing member, even when forcibly accelerating the scanning motor for start up, and the output time of the first print can be decreased.

Further features of the present invention will become apparent from the following description of exemplary embodiments with reference to the attached drawings.

DESCRIPTION OF THE EMBODIMENTS

The present invention will be described based on the embodiments with reference to the drawings. The dimensions, material, shapes, relative positions and the like of the components described in the embodiments are not intended to limit the scope of the invention.

[Embodiment 1]

(General Configuration of Image Forming Apparatus)

Figure 2:
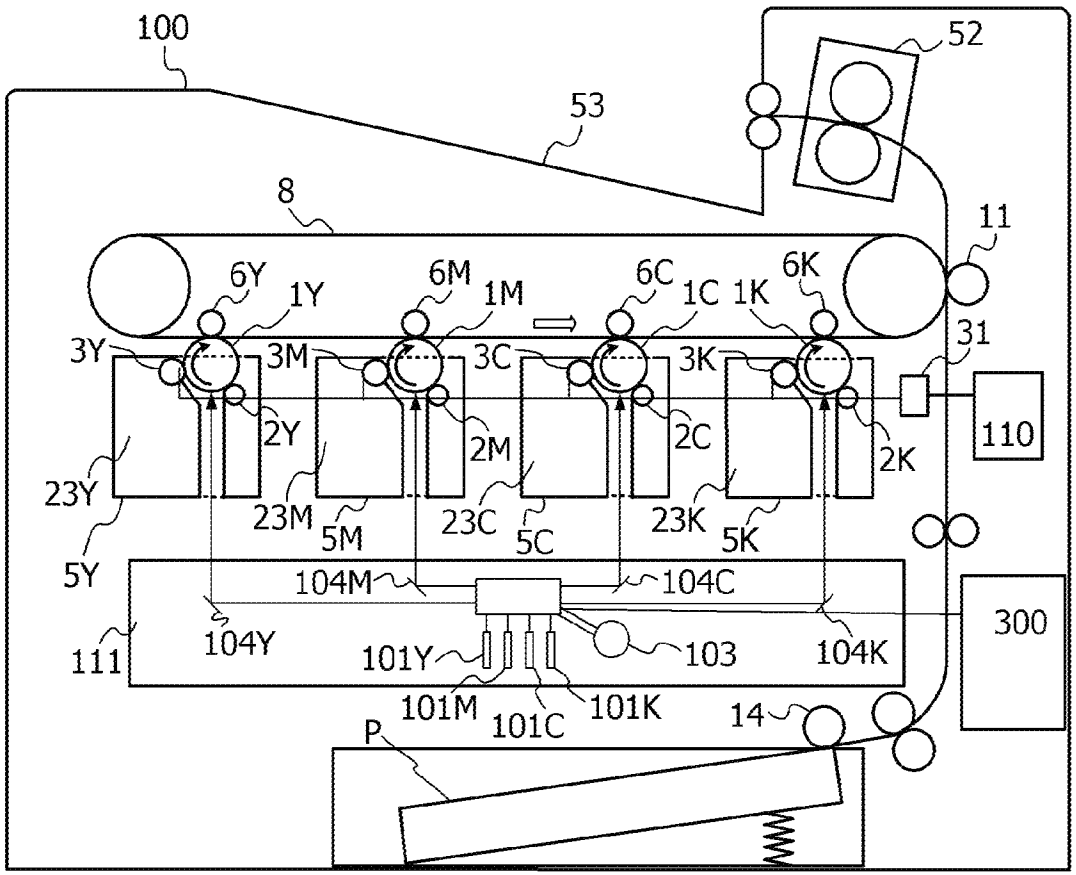
FIG. 2 is a diagram depicting a configuration example of an image forming apparatus to which the present invention is applied.

An image forming apparatus to which the present invention is applied will be described first. FIG. 2 is a cross-sectional view depicting a general configuration of the image forming apparatus 100.

This image forming apparatus 100 is an intermediate transfer system, where four process units 5Y, 5M, 5C and 5K are disposed in series along the rotation direction of an intermediate transfer member (hereafter "transfer belt") 8. This transfer belt 8 is constituted by an endless belt.

In each process unit 5Y, 5M, 5C and 5K, the print operation (image forming operation) is performed using toner (developer) having the individual colors yellow (Y), magenta (M), cyan (C) and black (K) respectively.

The image forming apparatus also includes a scanner unit 111, which is a scanning unit that irradiates a light beam to each photosensitive drum (image bearing member) 1Y, 1M, 1C and 1K disposed in each process unit 5Y, 5M, 5C and 5K.

Further, the image forming apparatus 100 includes a CPU 110 to control operation of each portion, and an image controller 300. The image controller 300 is electrically connected to the scanner unit 111, and forms an image using a modulated laser beam based on an image signal (image signal VDO) transmitted from the image controller 300.

In the scanner unit 111, lasers (laser elements) 101Y, 101M, 101C and 101K, a polygon mirror 102, a scanning motor 103 and reflecting mirrors 104Y, 104M, 104C and 104K are disposed. These lasers 101Y, 101M, 101C and 101K correspond to light sources that irradiate (emit) beams. The polygon mirror 102 corresponds to the rotating polygon mirror configured to reflect (deflection scanning) the beam irradiated from each laser 101Y, 101M, 101C and 101K respectively.

The beams emitted from the laser 101Y, 101M, 101C and 101K are reflected by the rotating polygon mirror 102, and are reflected back by the reflecting mirrors 104Y, 104M, 104C and 104K respectively. Then the beams reflected back are irradiated (forming images) on the photosensitive drums 1Y, 1M, 1C and 1K respectively. The scanning motor 103 is connected with the polygon mirror 102, and the polygon mirror 102 rotates as the scanning motor 103 rotates.

As described above, the image forming apparatus 100 constitutes an image forming unit (station) which forms an image on the photosensitive drums 1Y, 1M, 1C and 1K respectively for each color of the toner. Each station includes a process unit 5Y, 5M, 5C or 5K in which the photosensitive drum 1Y, 1M, 1C or 1K are disposed; a laser 101Y, 101M, 101C or 101K; and a reflecting mirror 104Y, 104M, 104C or 104K respectively. In Embodiment 1, each station shares one set of the polygon mirror 102 and the scanning motor 103, but two or more sets may be disposed.

The image forming operation (print operation) of this image forming apparatus will be described. Here the configuration and the operation of each process unit 5 are essentially the same, except for the color of the toner to be used. Therefore in the following, each process unit is described in general, omitting the Y, M, C and K attached to the reference sign in FIG. 2, unless a distinction is necessary.

In each process unit 5, the photosensitive drum 1, to which the light beam is irradiated, and a charging roller 2, to charge the photosensitive drum 1, are disposed. Further, developing roller 3, which is a developing member to develop adhering toner 23 only in the portions of the charged surface of the photosensitive drum 1 which the scanner unit 111 irradiated with the laser, is also disposed.

In the process unit 5, the distance of the developing roller 3 from the photosensitive drum 1 is controlled by a cam (not illustrated). By rotating this cam, the distance between the developing roller 3 and the photosensitive drum 1 is changed, whereby the developing roller 3 can be moved between the development position where the developing roller 3 contacts the photosensitive drum 1 and performs the developing operation, and the separated position where the developing roller 3 is separated from the development position.

The development position and the separated position where the developing roller 3 is separated can be switched by turning ON/OFF a developing solenoid 31 (moving unit) using a control signal from the CPU 110. The moving unit is not limited to the developing solenoid 31. In Embodiment 1, the developing roller 3 at the separated position is moved to the development position by driving the developing solenoid 31 after the scanning motor 103 is started. In other words, the developing operation becomes possible when the developing roller 3 comes to the position contacting the photosensitive drum 1. After the developing roller 3 contacts the photosensitive drum 1, the developing bias voltage is applied to perform the developing operation.

The time required for the developing roller 3 at the separated position to actually contact the photosensitive drum 1 after starting the contact operation varies depending on the product, due to mechanical variations and variations of the developing solenoids 31.

A transfer roller 6 is disposed at a position facing each photosensitive drum 1 via the transfer belt 8. When bias is applied to this transfer roller 6, a primary transfer portion is formed between the photosensitive drum 1 and the transfer belt 8, and the toner 23 on the photosensitive drum 1 is sequentially transferred to the transfer belt 8 (primary transfer).

When a start up rotation of the scanning motor 103 starts, a recording material P is picked up by a pick up roller 14, and feeding of the recording material P starts. At this time, the recording material P is fed to a secondary transfer portion, which is formed between the transfer belt 8 and a secondary transfer roller 11.

The toner image that is primarily transferred to the transfer belt 8 is secondarily transferred to the recording material P by the secondary transfer portion, and the recording material P, on which the toner image is transferred, is heated and pressed by a fixing unit 52, whereby the toner image is fixed to the recording material P. The fixed recording material P is discharged to a delivery tray 53, and the print operation completes.

(Configuration of Scanner Unit 111 and CPU 110)

Figure 3:
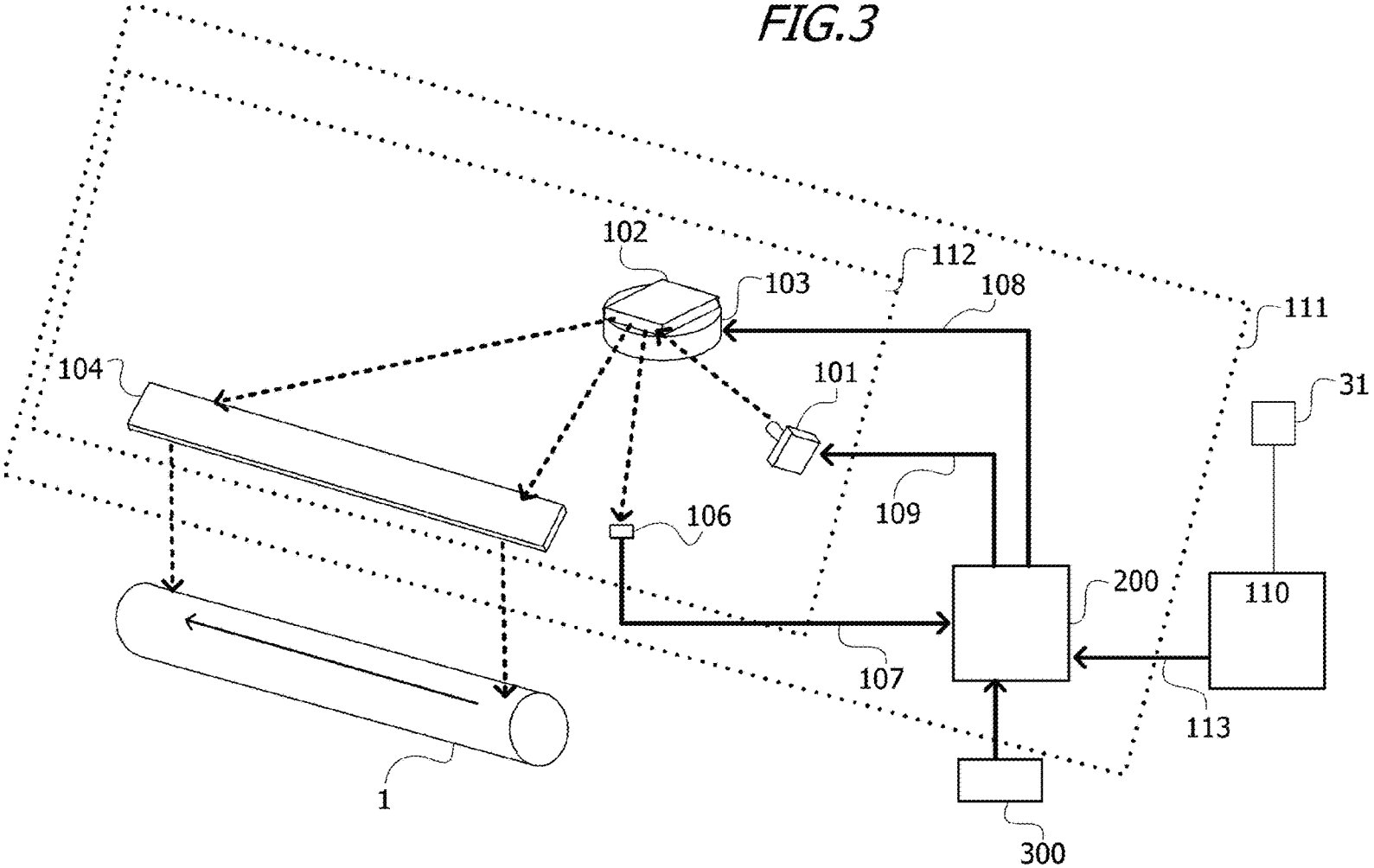
FIG. 3 is a perspective view of a scanner unit of the apparatus in FIG. 2.

FIG. 3 is a diagram depicting a general configuration of a scanning apparatus 112, including the above mentioned scanner unit 111 and a control system to control the scanner unit 111.

As mentioned above, the scanner unit 111 includes a laser 101 which is the light source to emit a laser beam, the polygon mirror 102 which is the rotating polygon mirror, and the scanning motor (drive unit) 103 which rotationally drives the polygon mirror 102. Furthermore, the reflecting mirror 104 which reflects the laser beam, reflected by the polygon mirror 102, back to the surface of the photosensitive drum 1 is disposed.

The laser 101 is constituted by a semiconductor laser, and the polygon mirror 102 periodically scans (deflection scanning) the photosensitive drum 1, which is the image bearing member, by reflecting the laser beam emitted from the laser 101. In Embodiment 1, the polygon mirror 102 has four surfaces, but the number of surfaces of the polygon mirror 102 is not limited to four.

106 is a BD sensor, which is a beam detecting unit, and generates a main scanning synchronization signal (synchronization signal in the main scanning direction) 107 when the laser beam is irradiated to the position of the BD sensor 106. The main scanning synchronization signal 107 is used as a scanning start reference signal in the main scanning direction, and is used as a reference to determine a start position for writing the image in the main scanning direction. The main scanning direction is a direction that is parallel with the rotation axis of the photosensitive drum 1.

200 is an ASIC which controls the scanning motor 103 and the laser 101, and communicates with the CPU 110 via a communication line 113, so that the ASIC 200 operates based on instructions from the CPU 110. The CPU 110 and the ASIC 200 constituted a control unit, which performs the driving control of the scanning motor 103 and the emission control of the laser 101.

In this configuration, the CPU 110 and the ASIC 200 are used, but the CPU 110 itself may control the scanning motor and the laser, or the laser may be emitted using a laser driving IC or the like.

The main scanning synchronization signal 107 is inputted from the BD sensor 106 to the ASIC 200, and a scanner motor driving signal 108 to rotate the scanning motor 103 and a laser driving signal 109 to turn the laser 101 ON are outputted from the ASIC 200, thereby controlling a rotation speed when the scanning motor 103 starts up.

An image controller 300 is connected to the ASIC 200 so that the laser 101 can be emitted based on the image information.

The CPU 110 also outputs a signal to drive the developing solenoid 31 to contact or separate the developing roller 3 to/from the photosensitive drum 1, whereby movement of the developing solenoid 31 is controlled.

(Description of Print Sequence)

The print sequence according to Embodiment 1 of the present invention will be described.

Figure 1:
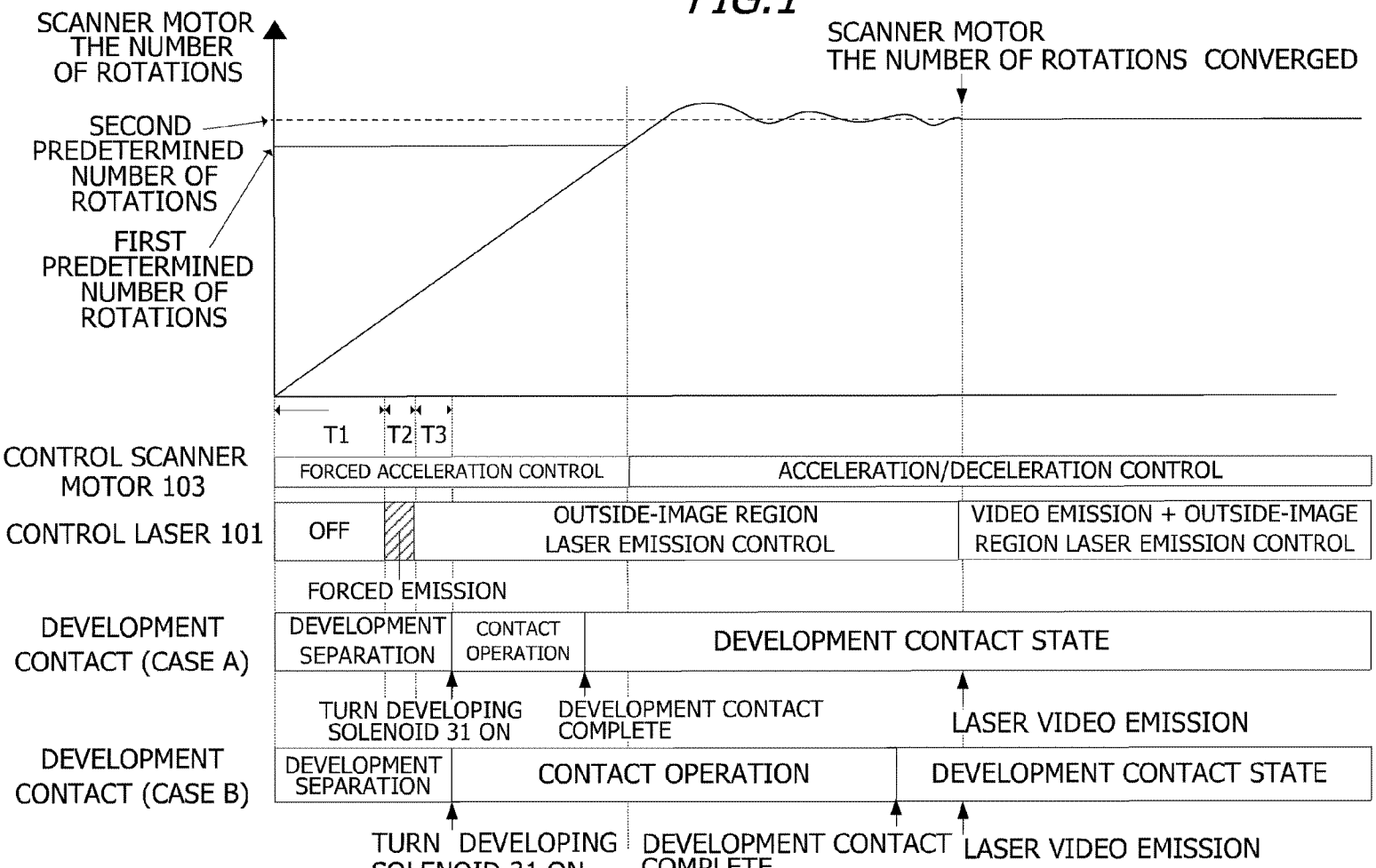
FIG. 1 is a diagram depicting a print sequence according to Embodiment 1 of the present invention.
Figure 10:
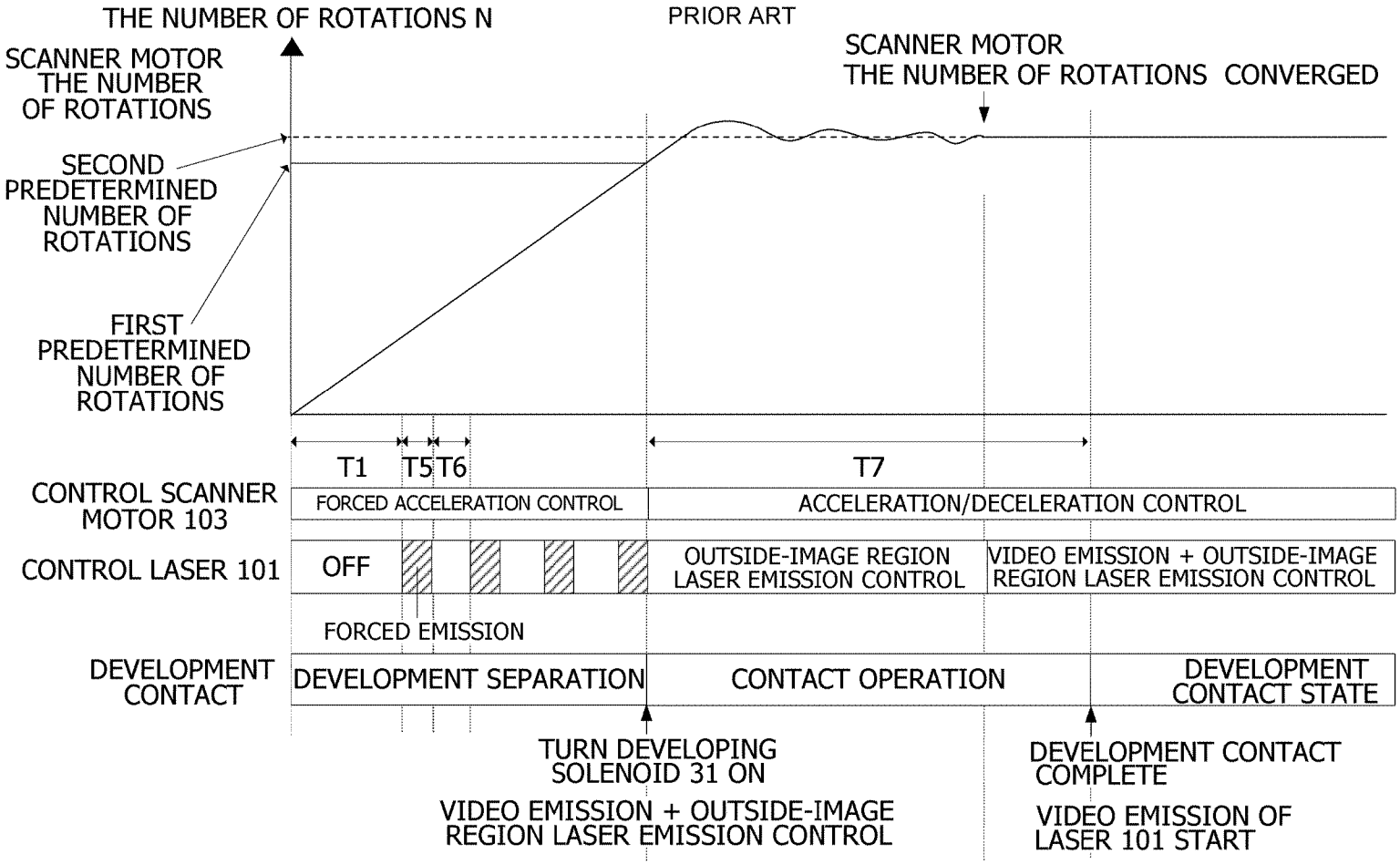
FIG.10 PRIOR ART
FIG. 10 is a diagram depicting the print sequence at start up according to a prior art.

To describe the features of Embodiment 1 of the present invention more clearly, a comparative example is depicted in FIG. 10. As indicated in FIG. 1, in the present invention, the contact operation of the developing roller is started during forced acceleration when the scanning motor starts up. The comparative example, on the other hand, is an example where the contact operation of the developing roller is not started during the forced acceleration when the scanning motor starts up, and the contact operation is started when the forced acceleration ends.

The comparative example will be described first with reference to FIG. 10.

When an external apparatus (not illustrated), such as a personal computer, sends a print start instruction to the image forming apparatus, the control when the rotation of the scanning motor 103 starts up is started, whereby the scanning motor 103 is driven and the polygon mirror 102 starts rotation. At this time, the scanning motor 103 is driven in a forced acceleration mode, in which the scanning motor 103 is forcibly accelerated at a predetermined rotational acceleration speed.

When an arbitrary time T1 elapses thereafter, the laser 101 is forcibly emitted, and the number of rotations (rotation frequency) of the polygon mirror 102 is measured based on the main scanning synchronization signal 107 detected by the BD sensor 106. Then after an arbitrary time T5 elapses from the forced emission of the laser, the laser 101 is turned OFF. Then after an arbitrary time T6 elapses from the laser turning OFF, forced emission is performed again. In this way, the forced emission and the turning OFF of the laser are repeated until the number of rotations reaches the first number of rotations M1.

After the number of rotations reaches the first number of rotations M1, the laser 101 is switched to the "outside-image region emission control", where the laser 101 is emitted outside the image region. Here the outside-image region emission control refers to a control in which the beam is not emitted to a region inside the image region of the photosensitive drum 1, so that the beam is detected outside the image region by the BD sensor 106, whereby the number of rotations of the polygon mirror 102 is detected. In other words, the emission timing of the laser 101 is controlled such that the beam does not enter the image region of the photosensitive drum 1, and the beam is detected outside the image region of the photosensitive drum 1 by the BD sensor 106. This control is also called unblanking light emission control. After the number of rotations of the scanning motor 103 reaches the first number of rotations M1 and the laser 101 is switched to the outside-image region emission control, the inside of the image region is not exposed, hence the developing solenoid 31 is turned ON to start contact operation of the developing rollers 3.

When the maximum time T7, from the turning ON of the developing solenoid 31 to the completion of the contact operation considering variations, elapses, the development contact operation completes, and video emission of the laser 101, which is modulated based on the image information during printing, is performed.

As a result, in the comparative example, the wait time is the maximum time T7 from the turning ON of the developing solenoid 31 to the completion of the contact operation, considering the time of mechanical variations and variations of the operation time of the solenoid itself, since the mechanical variations and the variations of the operation are large. After this time T7 elapses, the video emission of the laser, which is modulated based on the image information during printing, is performed.

Therefore even after the number of rotations of the scanning motor 103 converges with the target second number of rotations M2, some waiting time is generated until the video emission of the laser, which is modulated based on the image information during printing. For this amount of wait time, the first print output time becomes longer.

(Print Sequence of Embodiment 1)

The print sequence according to Embodiment 1 of the present invention will be described next.

According to Embodiment 1, when an external apparatus (not illustrated), such as a personal computer, sends a print start instruction to the image forming apparatus 100, the scanning motor 103 is started up and the start up rotation control is started, whereby the scanning motor 103 is operated, and the polygon mirror 102 starts rotation. When this rotation is started, the scanning motor 103 is driven in the forced acceleration mode, which is the same as in the comparative example.

When an arbitrary time T1 elapses thereafter, the laser 101 is forcibly emitted, including inside the image region, and the number of rotations of the polygon mirror 102 is measured by the BD sensor 106.

Then after an arbitrary time T2 elapses, emission control is switched to the unblanking emission control. In other words, the laser 101 is emitted outside the image region of the photosensitive drum 1, and the number of rotations of the polygon mirror 102 is detected based on the main scanning synchronization signal 107 from the BD sensor 106. Then the unblanking emission control is continued in accordance with the speed, and when a predetermined time T3 elapses, the developing solenoid 31 is driven to start the contact operation of the developing roller 3 toward the photosensitive drum 1. The above mentioned times T2 and T3 are set considering the maximum time, including variations until the developing roller 3 actually contacts the photosensitive drum 1, so that the contact operation completes before the number of rotations of the scanning motor 103 converges to the second number of rotations M2.

The timing when the developing roller 3 actually contacts the photosensitive drum 1 after driving the developing solenoid 31 differs depending on the apparatus. This variation of timing will be described.

(Case A)

Case A indicates a state when the contact is completed in a shortest time after the developing solenoid 31 is turned ON. In Case A, the contact of the developing roller 3 completes during the forced acceleration.

(Case B)

Case B indicates a state when the contact is completed in a longest time after the developing solenoid 31 is turned ON. In Case B, the contact of the developing roller 3 completes after reaching the first number of rotations M1 in the force acceleration state, and before converging to the second number of rotations M2.

In this way, there are two cases due to variations: a case when the contact completes while the scanning motor 103 is forcibly accelerated; and a case when the contact completes while acceleration/deceleration control is being performed after the forced acceleration.

In either case, in the state of the developing roller 3 having been moved from the separated position to the development position, when the scanning motor 103 starts to rotate, in other words, at the timing when the developing roller 3 contacts the photosensitive drum 1, the laser 101 is in the unblanking emission control state. Therefore developer does not adhere to the photosensitive drum 1.

In Embodiment 1, the timing of starting the unblanking emission control is set to a timing before starting the contact operation of the developing roller 3, but may be any timing before the contact operation of the developing roller 3 to contact the photosensitive drum 1 completes. Then when the number of rotations of the polygon mirror 102 reaches the first number of rotations M1, the scanning motor 103 is switched from the forced acceleration control to the acceleration/deceleration speed control.

Then it is determined whether the number of rotations M of the polygon mirror 102 has converged to the second number of rotations M2, and when converged, video emission of the laser, modulated based on the image information during printing, is performed.

[Unblanking Emission Control during Forced Acceleration]

A method of controlling the scanning motor 103, so as to perform unblanking emission during the forced acceleration control, will be described next with reference to FIG. 4.

Figure 4:
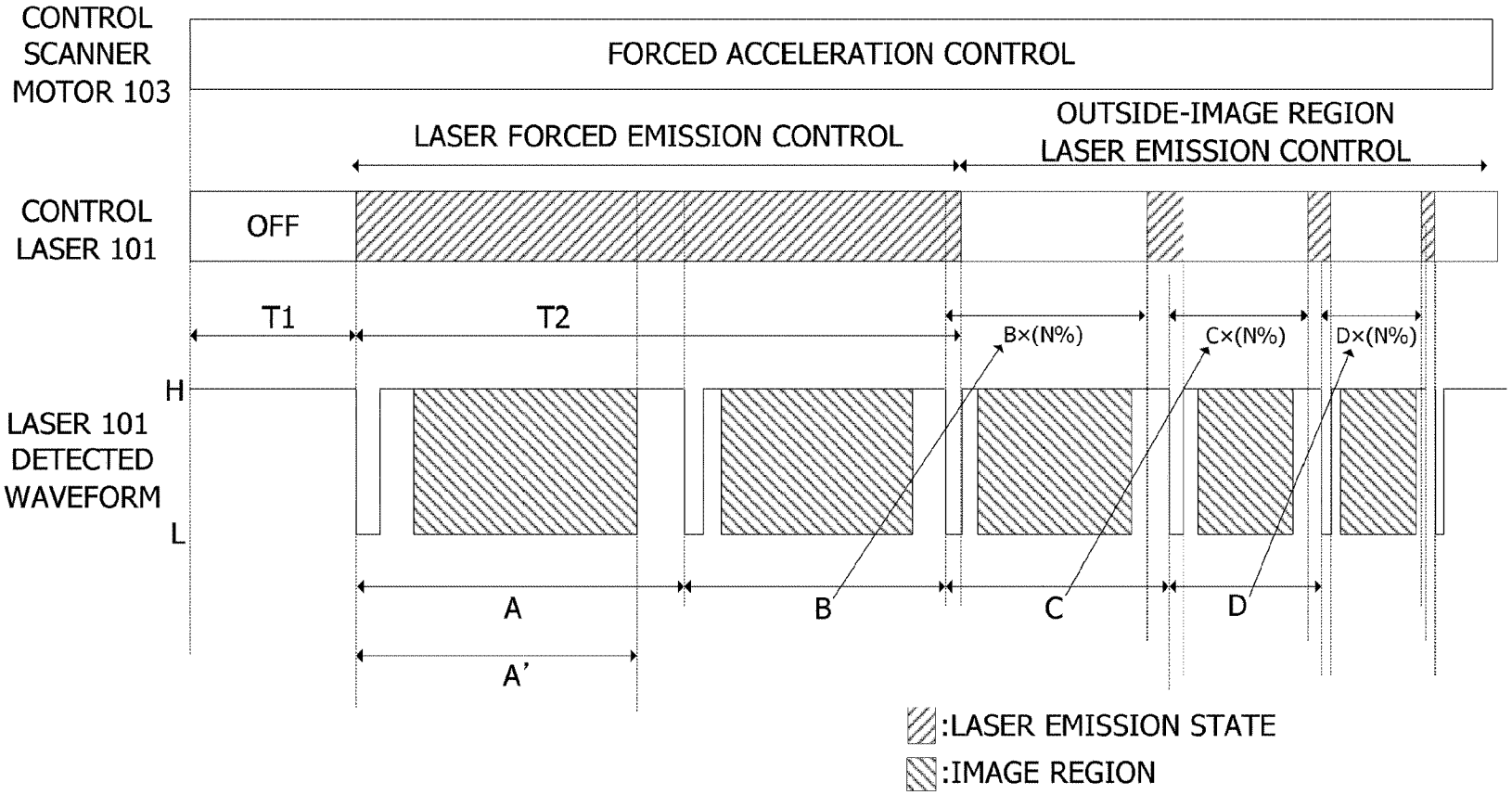
FIG. 4 is a diagram depicting the emission timing of the laser in FIG. 3.

FIG. 4 indicates the relationship of the timings of the control of the scanning motor 103, the emission control of the laser 101, and the laser light detection period.

First when time T1 elapses after the start of the forced acceleration of the scanning motor 103, the laser 101 is forcibly emitted. At this time, the periods when the BD sensor 106 detects the laser light are the periods indicated by A and B. In these periods, the number of rotations of the polygon mirror 102 is computed and detected. Hereafter these periods are called the "beam detect (BD) periods". In FIG. 4, the L level state is the laser light detection state.

As illustrated in FIG. 4, the BD periods gradually become shorter during the forced acceleration of the scanning motor 103.

Then when the time T2 elapses from the start of the forced emission, the forced emission is switched to the unblinking emission control (an outside-image region emission control). At this time, the final BD period of the forced emission is detected (period B in the example of FIG. 4).

Then a method of the outside-image region emission (unblanking emission) control will be described.

As illustrated in FIG. 4, to control the unblanking emission timing, the laser emission is started when N% of the previous BD period elapses, so that the laser beam is not emitted to a region inside the image region, and the laser beam of the next unblanking emission is detected by the BD sensor 106.

Figure 5:
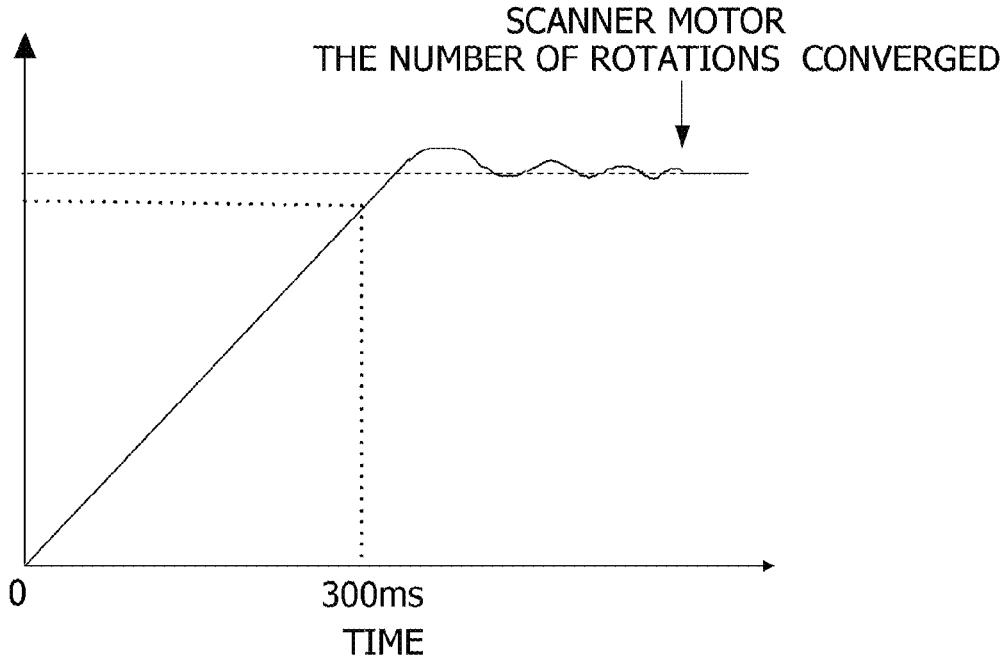
FIG. 5 is a graph depicting the relationship of the time and the number of rotations of the scanning motor in FIG. 2.

A method of determining the multiplying factor N will be described with reference to FIG. 5. FIG. 5 is a graph depicting an example of a relationship of time and the number of rotations when the scanning motor is started up.

In this example, the time required to reach the 30,000 rpm number of rotations from the start up is 300 ms. The scanning motor 103 accelerates approximately at a constant acceleration speed during a forced acceleration period.

In the case of the acceleration speed in this example, the change rate of consecutive BD periods during the forced acceleration is less than 1% when there are four polygonal surfaces on the scanning motor 103, and the BD period constantly become shorter during acceleration.

Figure 6:
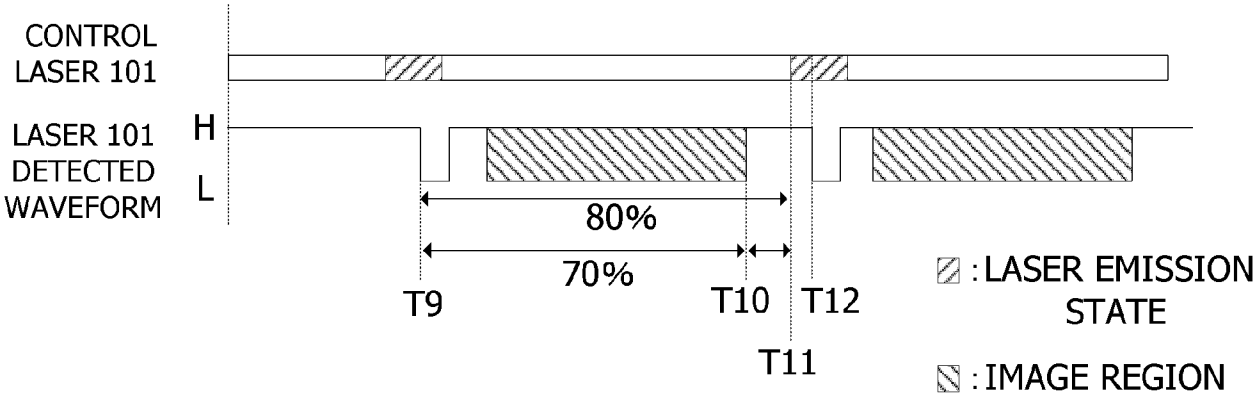
FIG. 6 is a diagram depicting an image region and the emission timing of the laser according to Embodiments 1 and 2.

FIG. 6 indicates the case when N=80%.

T9 and T12 in FIG.6 are beam entry timings when the beam enters the BD sensor 106. T10 in FIG.6 is an end timing of an image region of the photosensitive drum 1. And T11 in FIG.6 is a start timing of the laser emission for the beam to enter the BD sensor 106.

Here as an example, a system, where the image region ends when 70% of the BD period elapses from the beam entry timing T10 for the beam to enter the BD sensor 106, is considered.

In the scanning motor 103 of which acceleration speed is at the maximum, a condition for the beam to enter the BD sensor 106 without emitting light for the BD detection in the image region is T10<T11 and T11<T12.

A case when the change of BD is 1% or less during the forced acceleration, as indicated in FIG. 5, is considered.

The concept of T10<T11 will be described next.

In the case when the number of rotations increases 1% at the timing of T12 with respect to the number of rotations at the timing of T9, the timing of T11 starts slightly less than 1% earlier with respect to the previous BD period, and T11−T9 become about 79% of the previous BD period. As a result, T11 becomes closer to T10. Still in this case, (T10−T9)=about 70%<about 79%=(T11−T9), hence the image region is not exposed by the laser beam.

Actually the timing of T11 starts slightly before the timing of T10, hence the margin, in terms of satisfying the timing condition T10<T11, increases.

The concept of T11<T12 will be described next.

In the case when the number of rotations increases 1% at the timing of T12 with respect to the number of rotations at the timing of T9, the timing of T12 starts about 1% earlier, and T12−T9 becomes 99% of the previous BD period. As a result, T12 becomes closer to T11. Still in this case, (T11−T9)=about 80%<99%=(T12−T9), hence the beam always enters the BD sensor. In other words, the laser 101 always emits light at the time when the beam is supposed to enter the BD sensor 106.

Actually the laser emission start timing T11 starts slightly before the timing of T12, hence the margin, in terms of satisfying the timing condition T11<T12 increases.

As described above, the value of the multiplying factor N is determined based on an image region end timing (T10) and the beam entry timing to the BD sensor 106 (T12) in the actual system, so that T10<T11<T12 is always satisfied in the assumed acceleration speed during the start up of the scanning motor 103.

By determining the value of the multiplying factor N in this manner, unblanking control can be implemented.

(Description of Flow Chart)

Figure 7:
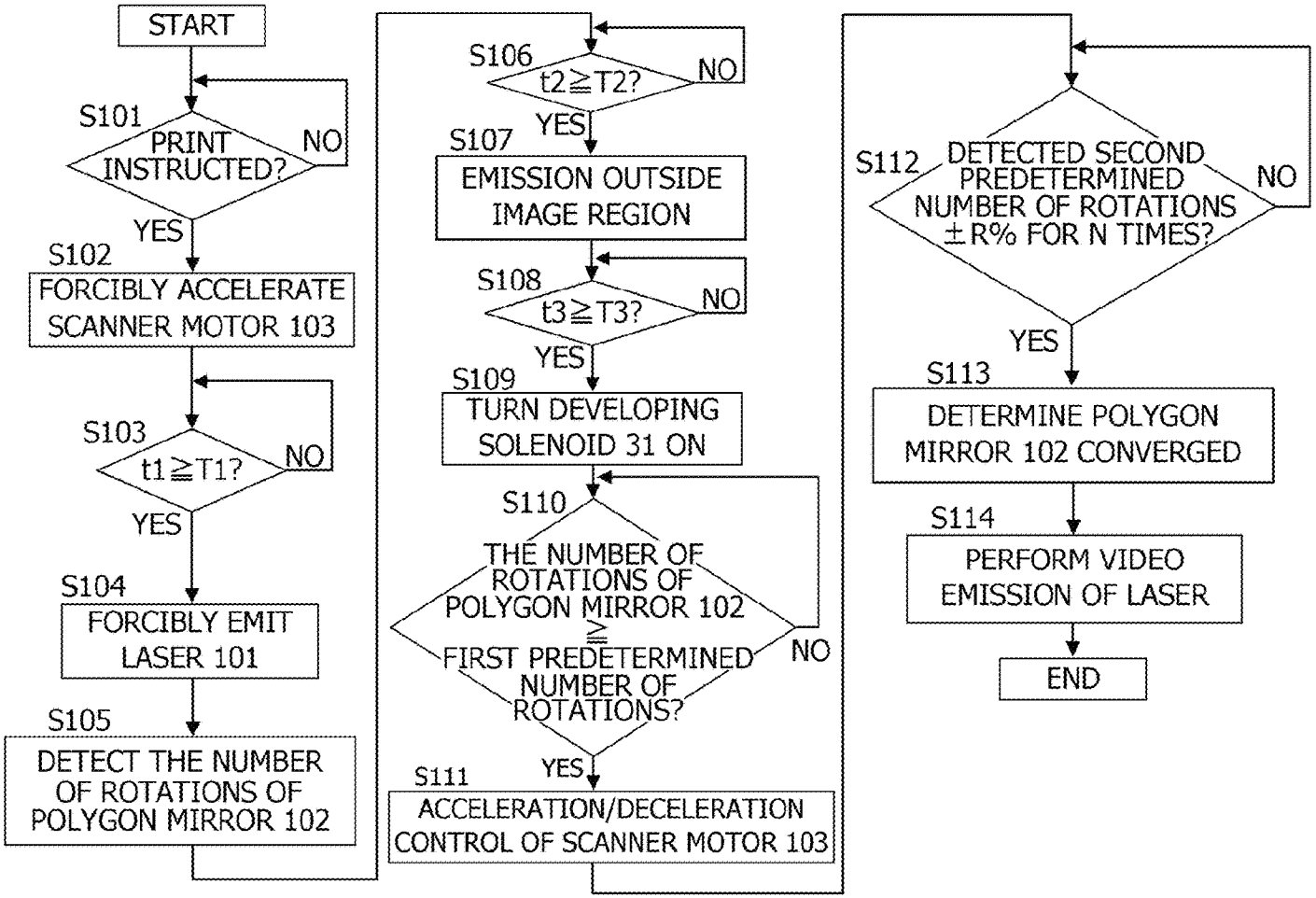
FIG. 7 is a flow chart at start up according to Embodiment 1.

The start up control of the scanning motor according to Embodiment 1 will be described with reference to the flow chart in FIG. 7.

When printing is instructed (S101), the ASIC 200 starts up the scanning motor 103 by forced acceleration using the scanner motor driving signal 108 based on the instruction from the CPU 110 (S102). Then it is determined whether the elapsed time tl, after starting up the scanning motor 103, is time T1 or longer (S103). When T1 or longer, the laser 101 is emitted in the forced emission state, including inside the image region (S104), and the number of rotations of the polygon mirror 102 is detected (S105).

Then it is determined whether the time t2 elapsed after the forced emission of the laser is T2 or longer (S106), and when T2 or longer, the emission of the laser 101 is switched to the unblanking emission which emits the light outside the image region (S107).

Then it is determined whether the time t3 elapsed after the unblanking emission is T3 or longer (S108). When T3 is longer, then the developing solenoid 31 is turned ON (S109), and it is determined whether the number of rotations of the polygon mirror 102 has reached the first number of rotations M1 (S110). When the predetermined number of rotations is reached, the scanning motor 103 is controlled to accelerate/decelerate (S111), and it is determined whether ±R % (R is arbitrary) of the predetermined number of rotations is detected for N times to determine whether the number of rotations of the polygon mirror 102 converges within ±R % of the second number of rotations M2 (S112).

When the number of rotations M is converged, it is determined that the rotation of the polygon mirror 102, that is the rotation of the scanning motor 103, converted (S113), and video emission of the laser, which is modulated based on the image information during printing, is performed (S114).

As described above, according to Embodiment 1, the contact operation to move the developing roller 3 to the development position is started when the scanning motor 103 is started up and the scanning motor 103 is forcibly accelerated. Then the laser beam is emitted outside the image region of the photosensitive drum 1 before the contact operation of the developing roller 3 completes, that is, before the developing roller 3 contacts the photosensitive drum 1. By performing this control, the contact operation of the developing roller 3 is started during the start up period of the scanning motor 103, and the developer does not adhere to the photosensitive drum 1 even if the developing roller 3 and the photosensitive drum 1 contact. Thereby video emission of the laser 101, which is modulated based on the image information during printing, can be performed immediately after the number of rotations of the scanning motor 103 converges to the predetermined number of rotations, without waiting for the elapse of the time which is set considering fluctuation generated in the period from the start of the contact operation of the developing roller 3 to the completion of the contact operation, and as a result, the output time of first print can be decreased.

[Embodiment 2]

Embodiment 2 of the present invention will be described next.

In the above mentioned control of Embodiment 1, when the scanning motor 103 is started up, the scanning motor 103 is forcibly accelerated until reaching the first number of rotations M1, and then acceleration/deceleration control is performed until the number of rotations converges to the second number of rotations M2. In Embodiment 2, however, the third number of rotations M3 is set between the first number of rotations M1 and the second number of rotations M2. From the first number of rotations M1 to the second number of rotations M2, a second acceleration control, in which acceleration speed is lower than that of the forced acceleration until reaching the first number of rotations M1, is performed.

In some cases, depending on the characteristic of the scanning motor 103, an overshoot may be better suppressed, and the time required for the number of rotations M to converge may decrease if the second acceleration control is performed before shifting to acceleration/deceleration control, rather than shifting directly from the forced acceleration control to the acceleration/deceleration control. For such a scanning motor 103, the control of Embodiment 2 is effective.

In the following description, different aspects from Embodiment 1 will be primarily described, and a composing portion the same as Embodiment 1 will be denoted with the same reference sign, and description thereof will be omitted.

(Description of Operation)

Figure 8:
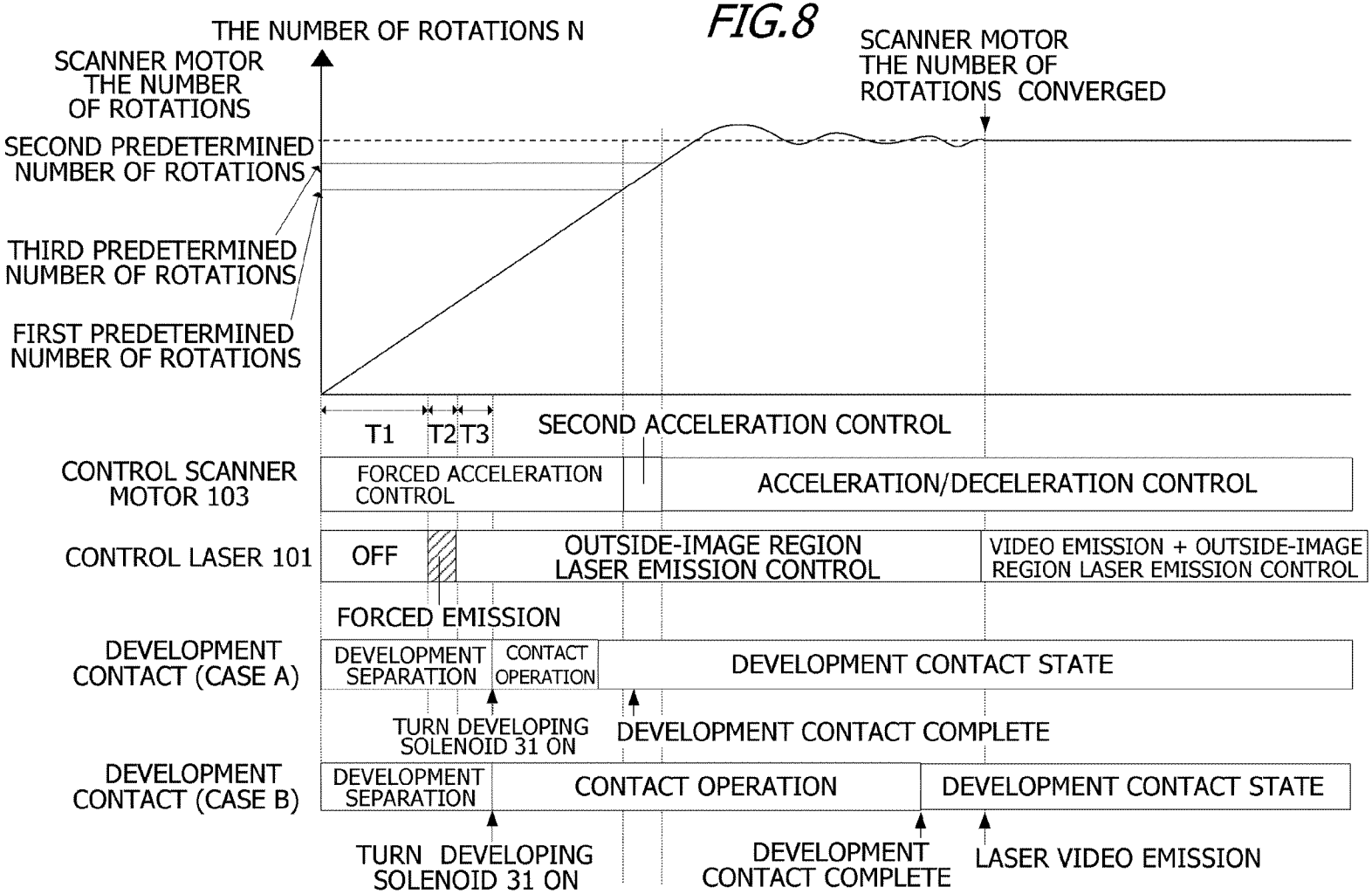
FIG. 8 is a diagram depicting the print sequence at start up according to Embodiment 2.

The print sequence according to Embodiment 2 of the present invention will be described next with reference to FIG. 8.

The sequence is the same as Embodiment 1 until the number of rotations of the polygon mirror 102 reaches the first number of rotations M1. When the number of rotations of the polygon mirror 102 reaches the first number of rotations M1, the forced acceleration control of the scanning motor 103 is switched to a second forced acceleration control in which acceleration speed is lower than the forced acceleration control.

Then it is determined whether the number of rotations has reached the third number of rotations M3, and when reached, the second forced acceleration control is switched to the acceleration/deceleration control.

Then it is determined whether the number of rotations of the polygon mirror 102 has converged to the second number of rotations M2, and when converged, the video emission of the laser, modulated based on the image information during printing, is performed.

(Description of Flow Chart)

Figure 9:
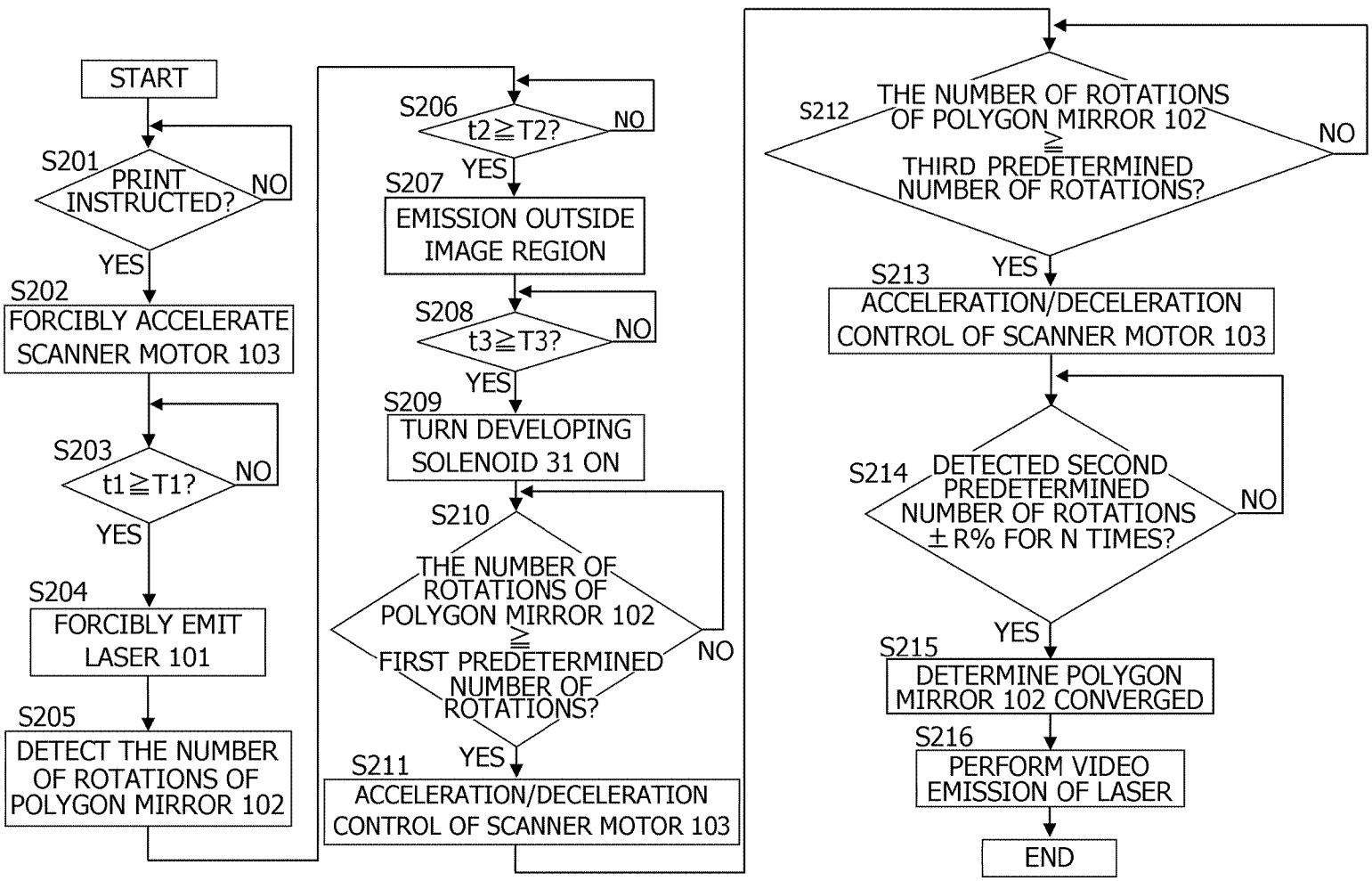
FIG. 9 is a flow chart at start up according to Embodiment 2.

The rotation speed control according to Embodiment 2 when the scanning motor is started up will be described with reference to the flow chart in FIG. 9.

Steps S201 to S210 are the same as steps S101 to S110 of Embodiment 1.

In step S210, it is determined whether the number of rotations of the polygon mirror 102 has reached the first number of rotations M1, and when reached, the second acceleration control is performed for the scanning motor (S211). Then it is determined whether the number of rotations of the polygon mirror 102 has reached the third number of rotations M3 (S212), and when reached, the acceleration/deceleration control is performed for the scanning motor 103 (S213).

Then it is determined whether the ±R % of the predetermined number of rotations is detected for N times (R and N are arbitrary) to determine whether the number of rotations of the polygon mirror 102 has converged within the ±R % of the second number of rotations M2 (S214). When converged, it is determined that the rotation of the scanning motor 103 has converged (S215), and the video emission of the laser, which is modulated based on the image information during printing, is performed (S216).

As described above, according to Embodiment 2, the second acceleration is performed before shifting from the forced acceleration mode to the acceleration/deceleration control, depending on the characteristics of the scanning motor 103. Thereby an overshoot of the number of rotations of the scanning motor 103 is suppressed, and the converging time of the number of rotations can be decreased. Furthermore, immediately after the number of rotations of the scanning motor 103 converged to a predetermined frequency, the developing voltage can be applied, and the output time of the first print can be decreased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-163643, filed on Aug. 28, 2017, which is hereby incorporated by reference herein in its entirety.

What is claimed is:

1. An image forming apparatus comprising:

a scanning portion including a light source configured to emit a light beam, a rotating polygon mirror configured to reflect the light beam emitted from the light source in order to periodically scan an image bearing member, and a drive portion configured to drive the rotating polygon mirror;

a detecting portion configured to receive the light beam that scans a second area which is different from a first area scanned with the light beam corresponding to image information among areas scanned with the light beam by the rotating polygon mirror;

a developing member configured to be movable between a development position where the developing member contacts the image bearing member and a separated position where the developing member is separated from the image bearing member; and a control portion configured to control emission of the light source, operation of the drive portion of the rotating polygon mirror and movement of the developing member, wherein the control portion controls a number of rotations of the drive portion based on a detection result of the light beam detected by the detecting portion during a start-up period for controlling the number of rotations of the drive portion so that the number of rotations of the drive portion reach a predetermined number of rotations, the control portion controls an emission state of the light source by switching between a first emission state in which the first area and the second area are scanned with the light beam and a second emission state in which the second area is scanned with the light beam, and during the start-up period, the light source is in the first emission state and the developing member is at the separated position when the drive portion is in a first rotation state, and the light source is in the second emission state and the developing member is at the development position when the drive portion is in a second rotation state, the number of rotations of the drive portion in the second rotation state being larger than the number of rotations of the drive portion in the first rotation state.

2. The image forming apparatus according to claim 1, wherein the control portion controls an emission timing of the light source so that: contact operation of the developing member is started such that the developing member moves from the separated position to the development position when the drive portion is forcibly accelerated during the start-up period; and the light source comes into the second emission state from the first emission state, before completion of the contact operation.

3. The image forming apparatus according to claim 2, wherein the control portion controls the emission timing of the light source so that the light source comes into the second emission state from the first emission state, before starting the contact operation of the developing member.

4. The image forming apparatus according to claim 3, wherein the control portion performs control during the start-up period, so that the drive portion is forcibly accelerated until the number of rotations of the drive portion reaches a predetermined first number of rotations, and the drive portion is switched to acceleration/deceleration control when the number of rotations of the drive portion reaches the first number of rotations, to allow the number of rotations of the drive portion to converge to a second number of rotations, which is higher than the first number of rotations and which is the predetermined number of rotations.

5. The image forming apparatus according to claim 3, wherein the control portion detects a number of rotations of the rotating polygon mirror during forced acceleration, by using a synchronization signal in a main scanning direction, which is generated when the detecting portion detects the light beam and which determines a start of image writing in a scanning direction, wherein the second emission state is a state in which the light beam does not enter the image region of the image bearing member and the light beam is detected outside the image region of the image bearing member by the detecting portion in the outside the image region, and wherein when the control portion controls emission of the light source so that the light source comes into the second emission state, the control portion determines an emission start timing on the basis of a period of the synchronization signal in the main scanning direction, the period being at least one period before a period of the synchronization signal in the main scanning direction where emission is attempted.

6. The image forming apparatus according to claim 3, wherein contact operation of the developing member is started when an acceleration speed of forced acceleration of the rotating polygon mirror is constant.

7. The image forming apparatus according to claim 2, wherein the control portion performs control during the start-up period, so that the drive portion is forcibly accelerated until the number of rotations of the drive portion reaches a predetermined first number of rotations, and the drive portion is switched to acceleration/deceleration control when the number of rotations of the drive portion reaches the first number of rotations, to allow the number of rotations of the drive portion to converge to a second number of rotations, which is higher than the first number of rotations and which is the predetermined number of rotations.

8. The image forming apparatus according to claim 2, wherein the control portion detects a number of rotations of the rotating polygon mirror during forced acceleration, by using a synchronization signal in a main scanning direction, which is generated when the detecting portion detects the light beam and which determines a start of image writing in a scanning direction, wherein the second emission state is a state in which the light beam does not enter the image region of the images bearing member and the light beam is detected outside the image region of the image bearing member by the detecting portion in the outside the image region, and wherein when the control portion controls emission of the light source so that the light sources comes into the second emission state, the control portion determines an emission start timing on the basis of a period of the synchronization signal in the main scanning direction, the period being at least one period before a period of the synchronization signal in the main scanning direction where emission is attempted.

9. The image forming apparatus according to claim 2, wherein contact operation of the developing member is started when an acceleration speed of forced acceleration of the rotating polygon mirror is constant.

10. The image forming apparatus according to claim 1, wherein the control portion performs control during the start-up period, so that the drive portion is forcibly accelerated until the number of rotations of the drive portion reaches a predetermined first number of rotations, and the drive portion is switched to acceleration/deceleration control when the number of rotations of the drive portion reaches the first number of rotations, to allow the number of rotations of the drive portion to converge to a second number of rotations, which is higher than the first number of rotations and which is the predetermined number of rotations.

11. The image forming apparatus according to claim 10, wherein the control portion sets a third number of rotations between the first number of rotations and the second number of rotations, and the control portion performs control so that the drive portion is forcibly accelerated until the number of rotations of the drive portion reaches the first number of rotations, the drive portion is switched to a second acceleration control, which accelerates the drive portion at an acceleration speed lower than the acceleration speed of the forced acceleration performed until the number of rotations of the drive portion reaches the first number of rotations, when the number of rotations of the drive portion reaches the first number of rotations, and the drive portion is switched to acceleration/deceleration control when the number of rotations of the drive portion reaches the third number of rotations, to allow the number of rotations of the drive portion to converge to the second number of rotations.

12. The image forming apparatus according to claim 11, wherein the second emission state is a state in which the light beam is detected outside the image region of the image bearing member by the detecting portion, and wherein when the control portion controls emission of the light source so that the light source comes into the second emission state, the control portion determines an emission start timing on the basis of a value generated by multiplying, by a predetermined multiplying factor, a period of a synchronization signal in a main scanning direction, the period being one period before a period of the synchronization signal in the main scanning direction where emission is attempted.

13. The image forming apparatus according to claim 10, wherein a timing of starting contact operation to move the developing member from the separated position to the development position is set so that the contact operation completes and the developing member reaches the development position before the number of rotations of the drive portion converges to the second number of rotations.

14. The image forming apparatus according to claim 1, wherein the control portion detects a number of rotations of the rotating polygon mirror during forced acceleration, by using a synchronization signal in a main scanning direction, which is generated when the detecting portion detects the light beam and which determines a start of image writing in a scanning direction, wherein the second emission state is a state in which the light beam does not enter the image region of the image bearing member and the light beam is detected outside the image region of the image bearing member by the detecting portion in the outside the image region, and wherein when the control portion controls emission of the light source so that the light source comes into the second emission state, the control portion determines an emission start timing on the basis of a period of the synchronization signal in the main scanning direction, the period being at least one period before a period of the synchronization signal in the main scanning direction where emission is attempted.

15. The image forming apparatus according to claim 1, wherein contact operation of the developing member is started when an acceleration speed of forced acceleration of the rotating polygon mirror is constant.

* * * * *